US005746507A

United States Patent [19]

Lee

[11] Patent Number: 5,746,507

[45] Date of Patent: May 5, 1998

[54] RECESSED LIGHTING FIXTURE FOR TWO LIGHT SIZES

[75] Inventor: Kiem T. Lee, Whittier, Calif.

[73] Assignee: Thomas Industries, Inc., Los Angeles, Calif.

[21] Appl. No.: 779,328

[22] Filed: Jan. 6, 1997

[51] Int. Cl.[6] ..... F21S 1/06

[52] U.S. Cl. ..... 362/365; 362/364; 362/366; 362/147

[58] Field of Search ..... 362/364, 365, 362/366, 147, 453, 454

[56] References Cited

U.S. PATENT DOCUMENTS

| | | | |
|---|---|---|---|
| 2,142,395 | 1/1939 | Herron | 362/364 X |
| 2,587,423 | 2/1952 | Young | 362/364 X |
| 2,602,881 | 7/1952 | Pryne . | |
| 2,678,381 | 5/1954 | Schwartz | 362/365 |
| 2,741,695 | 4/1956 | Schockett . | |
| 2,863,990 | 12/1958 | Wince . | |
| 2,929,920 | 3/1960 | Feig | 362/364 X |
| 3,130,949 | 4/1964 | Erhardt et al. | 362/365 X |
| 3,158,329 | 11/1964 | Wince . | |
| 3,313,931 | 4/1967 | Klugman | 362/364 X |
| 3,388,248 | 6/1968 | Auerbach | 362/453 X |
| 3,488,626 | 1/1970 | Koerper et al. . | |
| 3,697,742 | 10/1972 | Bobrick | 362/364 X |
| 3,783,176 | 1/1974 | Lund et al. . | |
| 3,852,585 | 12/1974 | Brunger . | |
| 3,872,296 | 3/1975 | Cohen et al. | 362/399 |
| 4,000,406 | 12/1976 | Bhavsar . | |
| 4,041,657 | 8/1977 | Schuplin . | |
| 4,118,760 | 10/1978 | Cohon . | |
| 4,293,895 | 10/1981 | Kristofek . | |
| 4,327,403 | 4/1982 | Capostagno et al. . | |
| 4,336,575 | 6/1982 | Gilman . | |
| 4,388,677 | 6/1983 | Druffel . | |
| 4,408,262 | 10/1983 | Koerper et al. . | |
| 4,459,429 | 7/1984 | Docimo . | |
| 4,482,940 | 11/1984 | Brandherm . | |
| 4,694,223 | 9/1987 | Compolo . | |
| 4,733,336 | 3/1988 | Skogler et al. . | |
| 4,764,851 | 8/1988 | Hartmann . | |
| 4,829,410 | 5/1989 | Patel . | |
| 4,894,759 | 1/1990 | Siems . | |
| 4,910,651 | 3/1990 | Montanez . | |
| 5,045,985 | 9/1991 | Russo et al. . | |
| 5,057,979 | 10/1991 | Carson et al. . | |
| 5,075,831 | 12/1991 | Stringer et al. . | |
| 5,077,650 | 12/1991 | Cestari | 362/365 |
| 5,124,901 | 6/1992 | Sojka et al. . | |
| 5,373,431 | 12/1994 | Hayman et al. | 362/364 |
| 5,374,812 | 12/1994 | Chan et al. | 362/364 |
| 5,410,462 | 4/1995 | Wolfe . | |
| 5,465,199 | 11/1995 | Bray et al. | 362/364 |
| 5,588,737 | 12/1996 | Kusmer | 362/148 |
| 5,597,234 | 1/1997 | Winkelhake | 362/364 |

FOREIGN PATENT DOCUMENTS

| | | |
|---|---|---|
| 595142 | 3/1960 | Canada . |

*Primary Examiner*—Ira S. Lazarus
*Assistant Examiner*—Nhat-Hang H. Lam
*Attorney, Agent, or Firm*—Hill, Steadman & Simpson

[57] ABSTRACT

A frame for a recessed light fixture having a opening for mounting a light reflector of a first size. A second opening of a smaller size is defined within the first opening so that a light reflector of the smaller size is mountable at the second opening should a smaller reflector be desired.

7 Claims, 5 Drawing Sheets

RECESSED LIGHTING FIXTURE FOR TWO LIGHT SIZES

BACKGROUND OF THE INVENTION

1. Field of the Invention

The present invention relates generally to a recessed light fixture, and more particularly to a plaster frame for a light fixture for recessed lighting which accommodates two sizes of lights.

2. Description of the Related Art

Light fixtures that are recessed in a ceiling of a room include a socket for the lamp or light bulb and a reflector to direct the light downward into the room. The socket and reflector are mounted above an opening in the ceiling and are supported in the structure of the ceiling on ceiling joists or on the grid of the suspended ceiling. In addition to the socket and reflector, the recessed light fixture generally includes a junction box for electrical connection to of the lamp to line power and may include a ballast for if the lamp is a fluorescent lamp.

These elements of the light fixture are supported on a plate that has come to be known as a plaster frame, although the ceiling need not be of plaster. The plaster frame generally includes an opening for placement in registration with the opening in the ceiling, at which is mounted the reflector. The plaster frame commonly includes a mounting location for a junction box and may include a mounting location for a ballast.

Recessed light fixtures are available in different sizes, specifically different diameters of the reflector for different ceiling opening sizes. A different plaster frame must be provided for each different size of light fixture.

SUMMARY OF THE INVENTION

The present invention provides a lighting supporting frame that is adaptable to support at least two different sizes of recessed light fixtures, thereby reducing inventory and simplifying installation.

The invention also provides a frame for a recessed light that mounts above the ceiling to support the light fixture using standard mounting components.

A feature of the invention is that ballasts for the lamp and junction boxes for the electrical connections are easily mounted onto the support frame, either before or after placement of the frame in position.

These and other features and advantages of the invention are provides by a one piece light fixture supporting frame, or plaster frame, for a recessed light having a generally planar body with an opening through the body for mounting a reflector of a recessed light. The portion of the body adjacent the opening is provided with a reflector mounting and a downwardly extending lip that extends into an opening in the ceiling through which the light is projected into the room. The reflector mounting at the opening in the frame and the lip which extends through the ceiling opening are preferably of a standard size for recessed lights. An important feature of the present frame is that within the frame opening is provided a second reflector mounting and a second lip for a smaller size reflector. The second reflector mounting and the second lip are positioned lower than the first reflector mounting and the first lip relative to the ceiling plane so that the second lip may be positioned extending into a ceiling opening of the smaller size while the first lip is above the plane of the ceiling.

The present light supporting frame has a lower planar surface that rests on or just above the upper surface of the ceiling panel when the first lip is positioned in a ceiling opening of the larger size. The frame is mounted at a position with the lower planar surface thereof spaced above the upper surface of the ceiling plane and the first lip resting on or just above the upper surface of the ceiling panel when the smaller second lip is positioned in a ceiling opening of the smaller size. Preferably, the inner reflector mounting and lip is removable from the frame when the frame is used in the larger openings.

The invention provides a mounting arrangement for mounting the support frame at the two vertical positions required for the two different sized reflector mounts. Specifically, the frame is mountable using standard mounting hardware on the support grid of a suspended ceiling and may be mounted with the lower surface resting on the ceiling for the larger opening or spaced above the ceiling plane for the smaller ceiling opening.

The ballast mounting for the present invention provides for easy and quick connection of the ballast to the support frame without requiring the use of tools and without fasteners at the plane of the ceiling. As an added benefit, the weight of the ballast is primarily supported on the ceiling grid, the connection to the light support frame serving to maintain the ballast in position.

Similarly, the junction box is snap fit onto the support frame and the doors on the junction box snap into place.

DETAILED DESCRIPTION OF THE PREFERRED EMBODIMENTS

Figure 1:
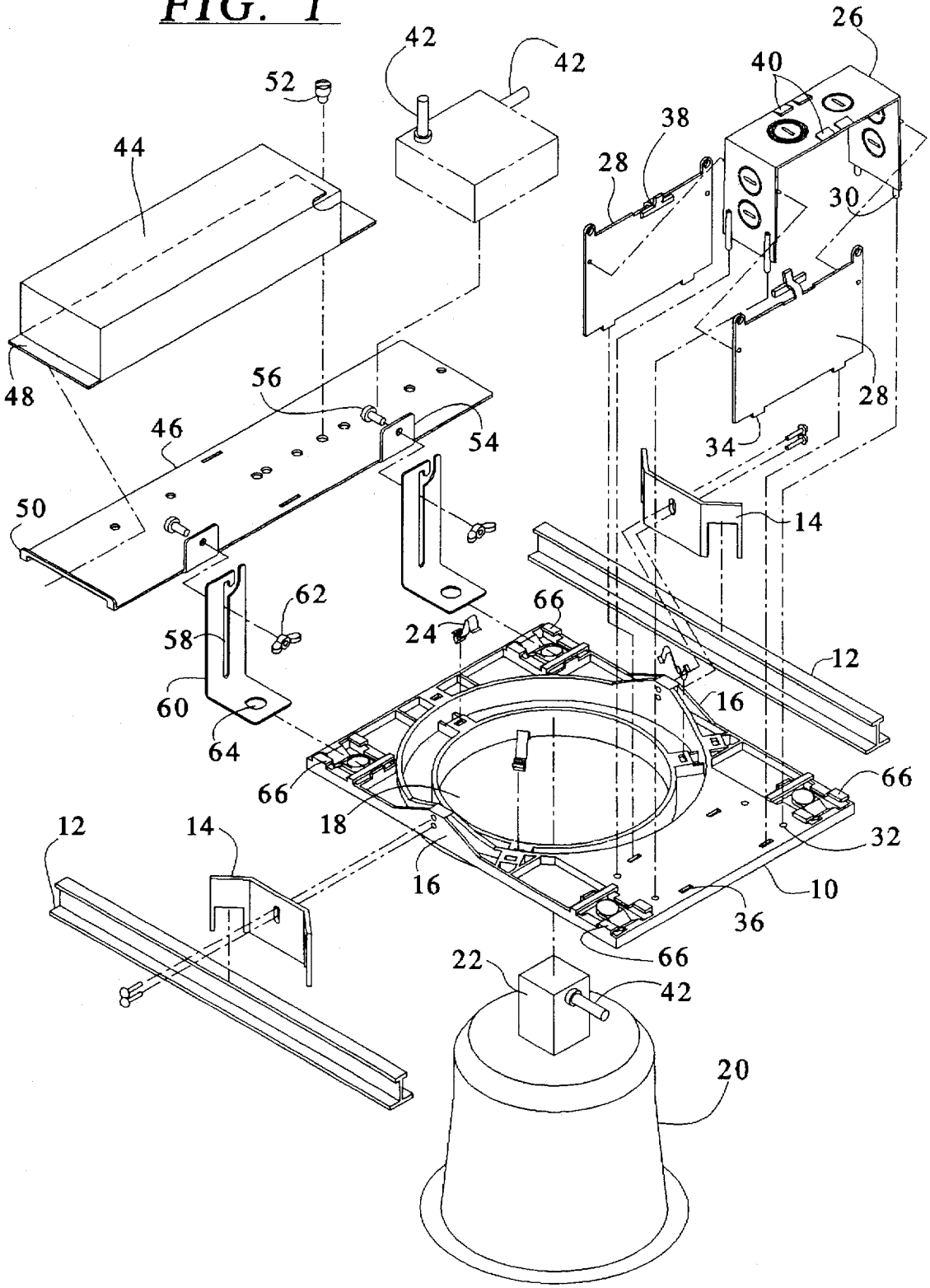
FIG. 1 is an exploded perspective view of a recessed light fixture including a support frame according to the present invention with a reflector and socket assembly, a ballast assembly and a junction box.

Referring first to FIG. 1, the support frame 10 for recessed lighting of the invention is mounted between two channel members 12 of a suspended ceiling such that the frame 10 is disposed above the plane of the ceiling. The frame 10 is held in position by butterfly clips 14 which clip over the top of the channel members 12 and are fastened to clip mounting locations 16 on the support frame 10. The support frame 10 has a generally planar shape with an opening 18 that is positioned in registration with an opening in the ceiling. A reflector can 20 and lamp socket 22 is mounted so that light from a lamp or light bulb in the lamp socket 22 shines through the ceiling opening and into a room. The reflector 20 is held in the opening 18 by reflector clips 24.

On the top surface of the frame 10 is mounted a junction box 26 with removable doors 28. The junction box 26 connects to the support frame 10 by mounting pegs 30 that fit into holes 32 in the frame 10. The doors 28 have tabs 34 that are inserted into slots 36 in the support frame 10. The doors 28 have resilient catches 38 at the upper sides that engage behind raised ramps 40 on the junction box 26 to hold the doors 28 in place.

A ballast is often needed for the lamp mounted in the lamp socket 22. In FIG. 1, a ballast 44 is positioned on a ballast tray 46 with an extension 48 on the ballast 44 extending through a slot in an upturned end 50 of the ballast tray 46. An opposite end of the ballast is fastened to the ballast tray 46 by a bolt 52. Various holes are provided in the ballast tray 46 for connection of ballasts of different sizes and shapes. The ballast tray 46 has a pair of tabs 54 with bores for threaded bolts 56. The bolts 56 extend through shaped slots 58 in L-shaped brackets 60 and wing nuts 62 are placed on the bolts 56. The portion of the L-shaped brackets 60 with the shaped slots 58 are positioned vertically, and a lower portion thereof which has a hole 64 is slid into a resilient latch 66 on the support frame 10. A pair of the resilient latches 66 is provided at each end of the support frame 10 so that the ballast 44 may be mounted at either one end or the other, as desired.

Electrical cables 42 connect the various elements of the light fixture to one another to provide power to the components as needed.

The channel members 12 of the ceiling grid are closer together than shown in the exploded view of FIG. 1 and the ballast tray 46 is long enough to rest on the tops of the channel members 12. The shaped slots 58 permit the ballast 44 to be added and positioned resting on the channel members 12 after the support frame 10 is in position and the L-shaped brackets 60 are engaged in the resilient latches 66. The shaped slots 58 are open at the top so that the wing nuts 62 need not be completely removed from the bolts 56 to insert the bolts 56 into the slots 58, yet the top end of the slots 58 have a blind end to prevent inadvertent removal of the ballast once it is in place. This facilitates installation of the present fixture within the ceiling, which may be performed through the ceiling opening for the recessed light.

Figure 2:
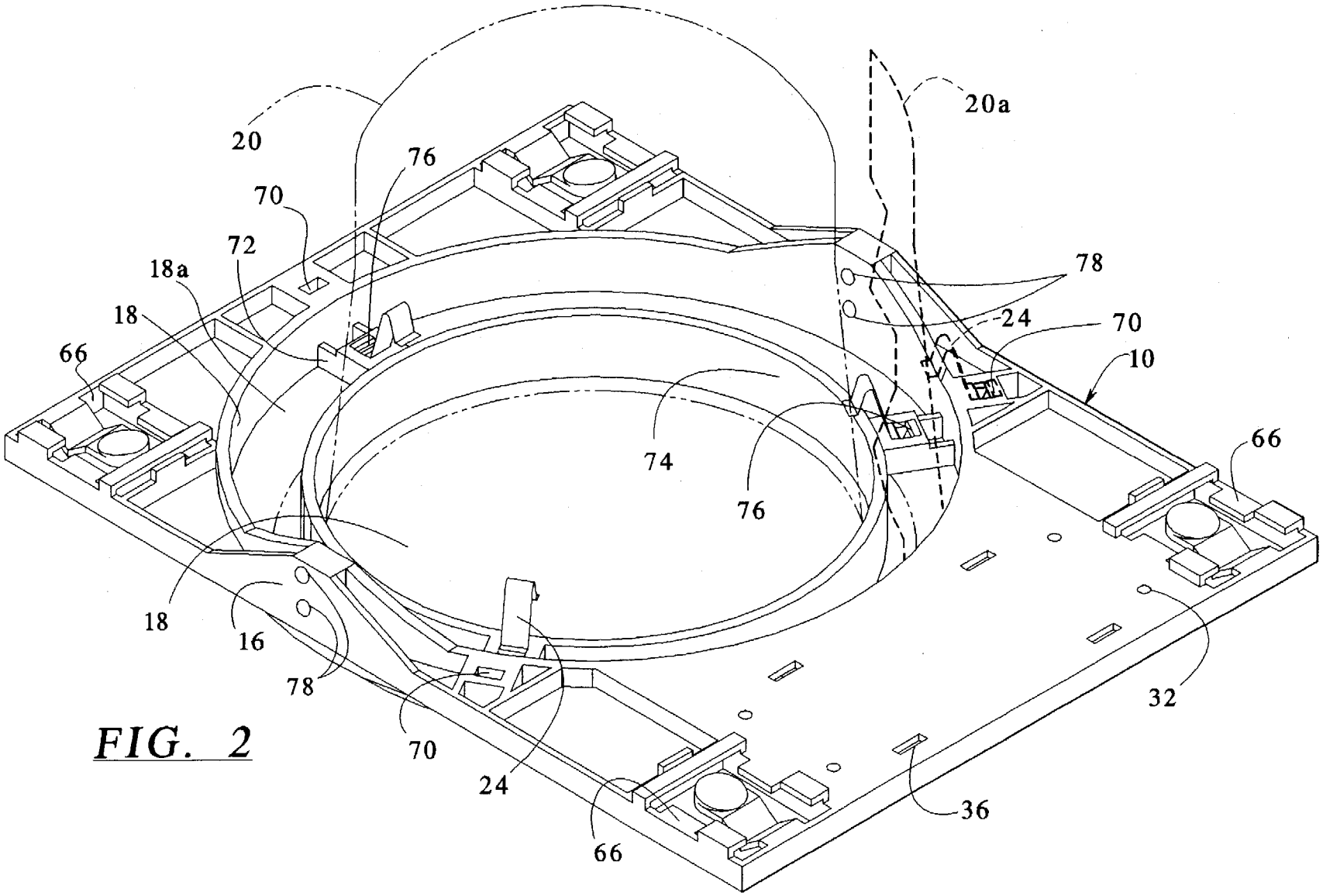
FIG. 2 is a top perspective view of the support frame of FIG. 1 including reflectors of different sizes shown in phantom mounted thereon.

FIG. 2 reveals more detail of the support frame 10 for the present invention. Of particular significance is the opening 18*a* at which the reflector can is mounted. The opening is defined by a cylindrical wall 68 which continues below the plane of the lower surface of the support frame 10 to provide a cylindrical lip that extends through the opening in the ceiling. Around the opening 18*a* is arranged receptacles 70 for holding the reflector holding springs 24 that support the reflector 20*a*. Within the opening 18*a* extending radially inward from the cylindrical wall 68 are struts 72 which connect to a second cylindrical wall 74 which defines another central opening 18 of a smaller diameter than the opening 18*a*. This second cylindrical wall 74 also includes receptacles 76 for the reflector mounting clips 24 so that a smaller reflector 20 may be mounted on the smaller opening 18.

Also shown in FIG. 2 is the clip mounting locations 16 which are raised above the top plane of the support frame and reinforced so as to support the frame 10 on the clips 14 (shown in FIG. 1). Two bores 78 are provided through the clip mounting locations 16 for attachment of the clips 14.

Figure 3:
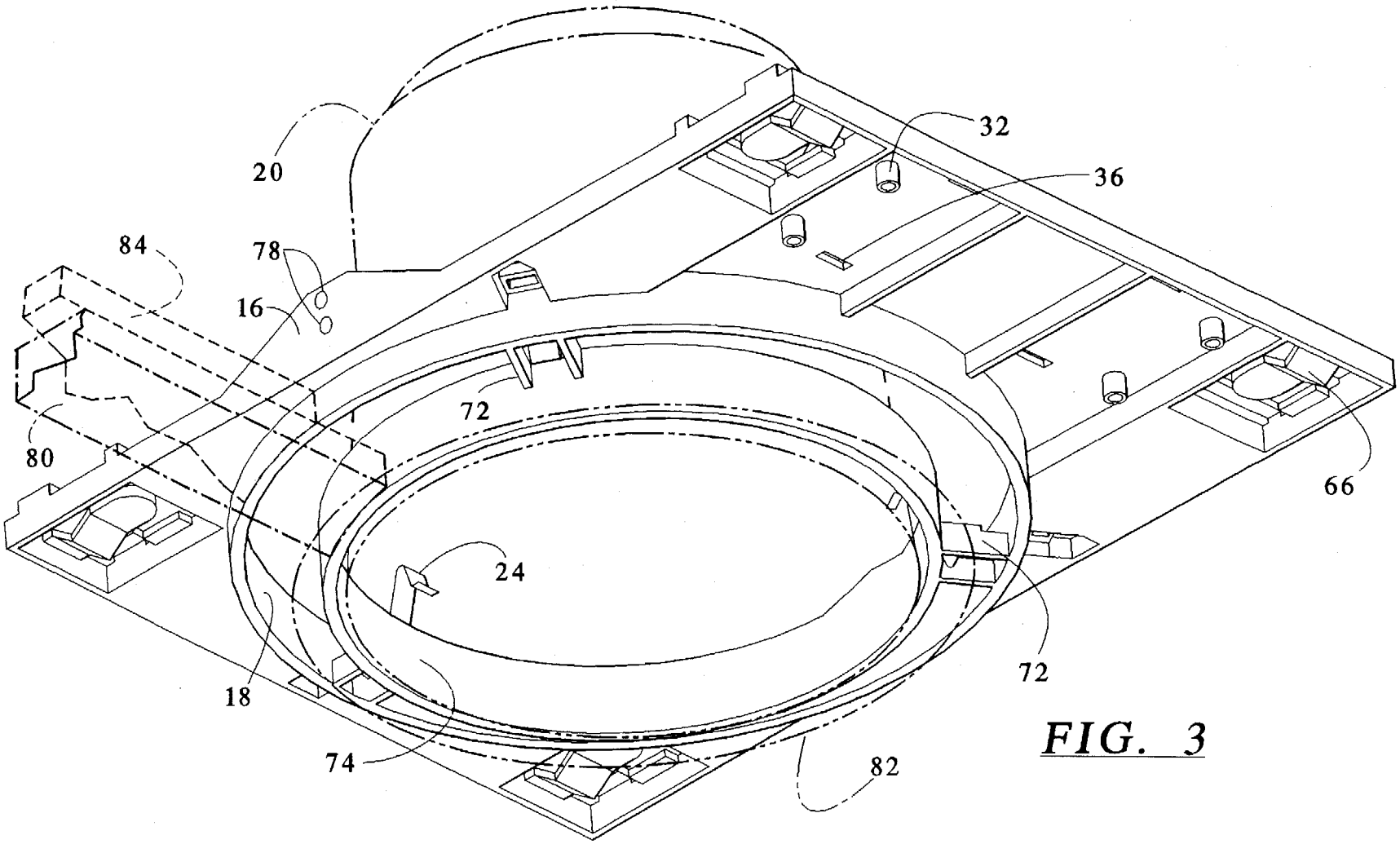
FIG. 3 is bottom perspective view of the support frame of FIG. 2 with the reflector and a trim ring illustrated in phantom and two different ceiling positions indicated in broken outline.

As shown in FIG. 3, the smaller inner cylindrical wall 74 also extends downward to define a lip extending below the plane of the lower surface of the support frame 10. The lip of the smaller, inner cylinder 74 also extends lower—or farther below the support frame 10—than the lip of the larger; outer cylinder 68. When the support frame 10 is used in a recessed light fixture of the smaller diameter, the reflector 20 is mounted on the smaller ring 74 by the clips 24 being held in the receptacles 76 in the struts 72. The receptacles 76 are formed in cross pieces that spans the two legs of the strut 72. The cylindrical wall of the inner ring 74 extends through the opening in the ceiling 80, a portion of which is schematically shown in FIG. 3. A trim ring 82, shown in broken outline, is mounted on the underside of the ring 74 to provide a finished appearance in the room. The support frame 10 rests on the lip of the larger diameter cylindrical wall 68.

When used with a larger light fixture, the struts 72 are clipped off from the inside of the larger cylindrical wall 68 and the smaller cylindrical wall 74 and the struts 72 are removed. The support frame 10 is then positioned with the lip of the larger cylindrical wall 68 (which is the only one remaining on the frame) extending through the ceiling opening, as shown by the schematic representation of the ceiling at 84. The support frame 10 therefore sits lower relative to the ceiling when used to mount a larger diameter reflector 20*a* than when used for the smaller reflector 20.

Figure 4:
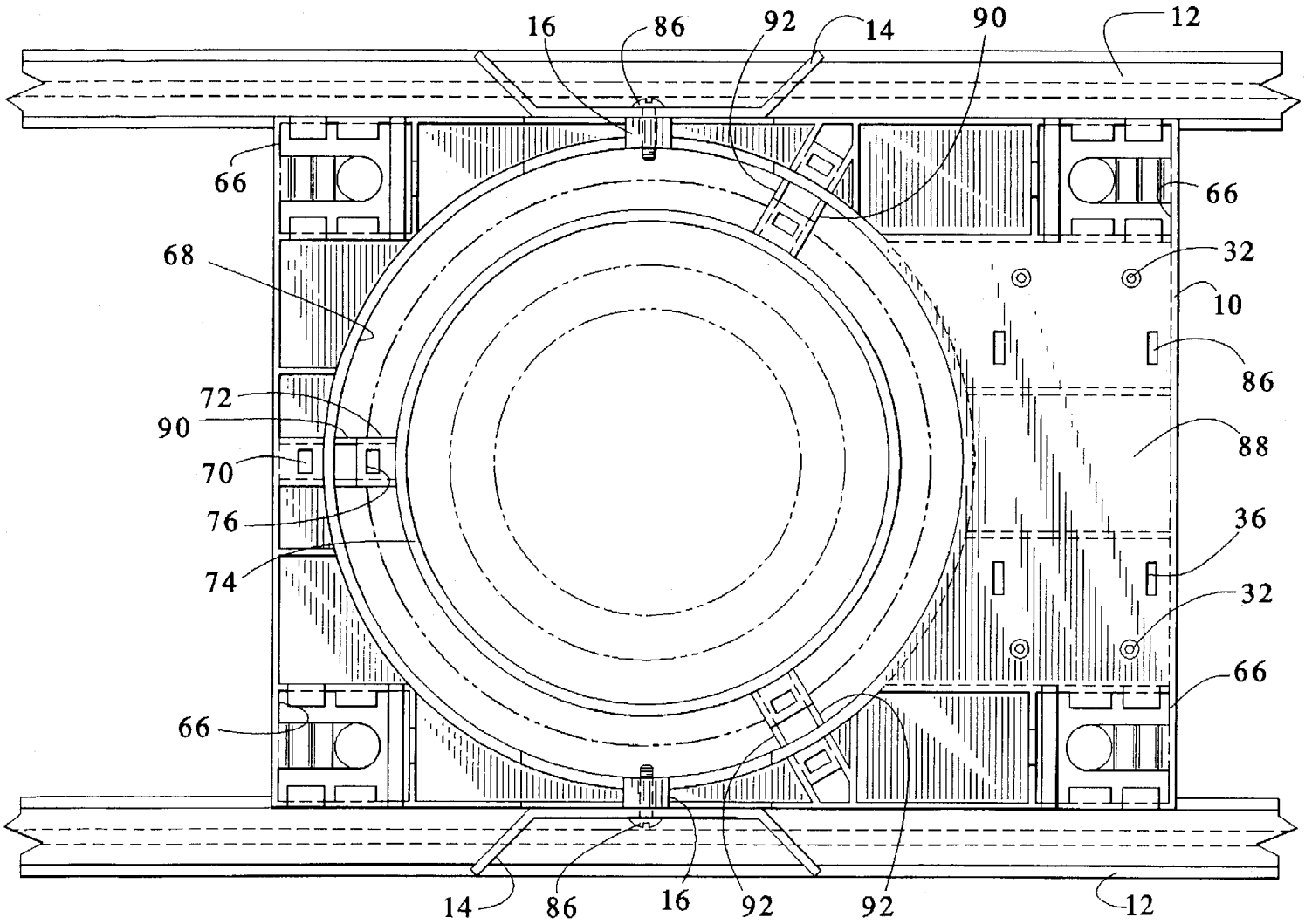
FIG. 4 is a top plan view of the support frame of the invention mounted between channel members of a ceiling grid.

FIG. 4 provides a view from the top of the frame 10 with the channel members 12 on either side of the support frame 10, the butterfly clips 14 being mounted over the channel members 12 and fastened to the clip mounting locations 16 by screws 86 that extend through the bores 78. The cylindrical wall 68 which defines the opening 18*a* is offset from the center of the support frame 10 to provide an area 88 on which the junction box 26 is mounted. As is readily apparent from FIG. 4, the inner cylindrical wall 74 is concentric with the larger diameter cylindrical wall 86. The struts 72 which support the inner wall 74 concentrically is thinned at locations 90 at the outer cylindrical wall 68 so that it may be readily clipped off for removal of the smaller ring 74 when a larger light fixture is used. This thinned location 90 in the preferred embodiment includes two legs 92 without a cross piece extending therebetween and which are of a lesser vertical extent than the balance of the strut 72.

Figure 5:
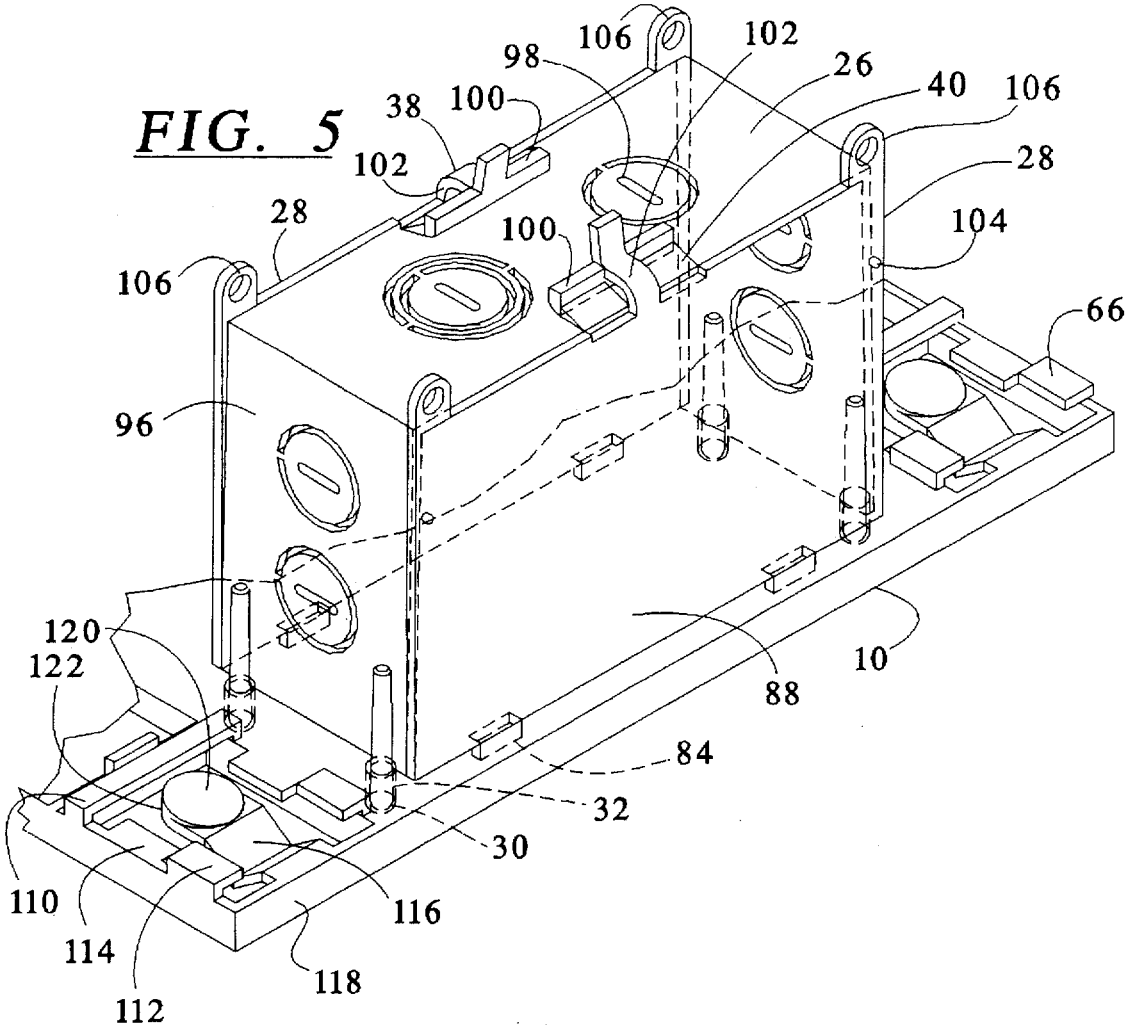
FIG. 5 is a perspective view of a junction box mounted on the support frame of the invention.

A junction box 26 as shown in FIG. 5 is provided for mounting on the support frame 10 at the area 88. The junction box 26 includes a U-shapedframe 96 mounted inverted on the support frame 10 with the pegs 30 inserted into the holes 32 in the support frame 10. The U-shaped frame 96 includes knock-outs 98, as is common in electrical junction boxes, which are removable for passing electrical wiring therethrough. The sides of the junction box 26 are closed by the doors 28 which have the tabs 34 at the lower edge that fit into the slots 36 on the support frame 10. A horizontal catch member 100 on a resilient curved arm 102 form the catch 38 for engagement behind the ramps 40 on the top surface of the U-shaped frame 26. An additional alignment means is provided in the form of small posts 104 on the U-shaped frame 26 that engage into openings formed on the doors 28 so that proper alignment of the door 28 on the junction box frame 26 is achieved. The doors 28 of the illustrated embodiment have hangers 106 at the top edge thereof.

Figure 6:
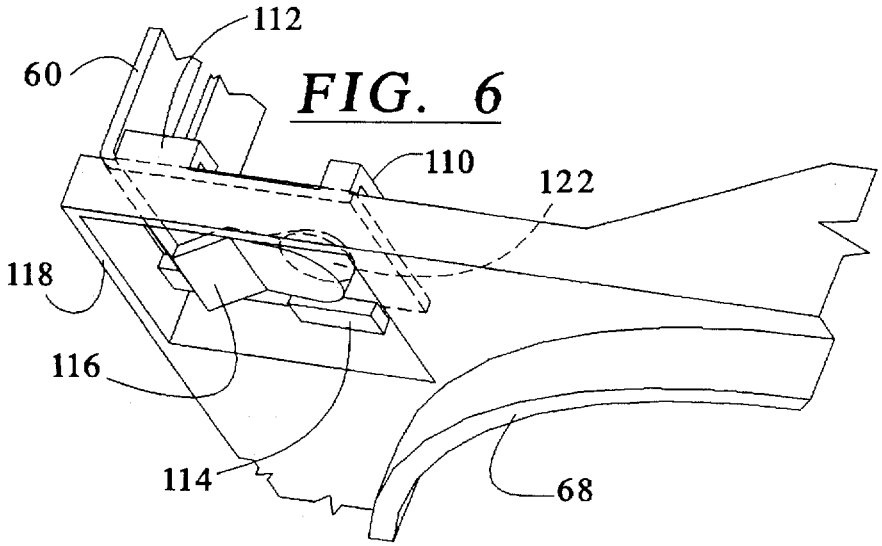
FIG. 6 is a bottom perspective view of a clip portion of the support frame for mounting a ballast bracket.

The installation of the present support frame 10 is simplified by the L-shaped ballast brackets 60 that easily attach to support frame 10. As shown in FIGS. 5 and 6, the present support frame 10 includes at each corner a resilient clip 66 into which the ballast brackets 60 are engaged. A channel for receiving the ballast bracket 60 is formed by a crossbar 110 and a partial crossbar 112 that extend at the top of the channel and a partial crossbar 114 at the bottom of the channel. The channel is open to the side of the support frame 10 so that the ballast bracket 60 may be slid thereinto. A resilient arm 116 extending from an edge 118 of the support frame at the open end of the channel has a ramp 120 on the top surface of a circular catch 122. The ballast bracket 60 has a similarly sized circular opening 64 into which the circular catch 122 engages when the ballast bracket 60 is in position in the channel.

As a further possibility, it is contemplated to add further inner rings of smaller sizes within the second ring so that additional sizes of light fixtures may be accommodated in the single frame of the invention.

Thus, there is shown and described a support frame for a recessed light fixture that provides a mounting for two different sizes of reflectors at two different sizes of ceiling openings, thereby reducing the inventory required for ceiling fixtures Although other modifications and changes may be suggested by those skilled in the art, it is the intention of the inventor to embody within the patent warranted hereon all changes and modifications as reasonably and properly come within the scope of his contribution to the art.

I claim:

1. A recessed light frame for mounting a light and reflector at an opening in a ceiling above a plane of the ceiling, comprising:

a generally planar member defining an opening of a first size for the light and reflector;

reflector mounting means adjacent the opening in said generally planar member on which is mountable;

struts extending inwardly of the opening, said struts being selectively removable;

means on said struts defining an opening of a second size, wherein said second size is smaller than said first size and said opening of said second size is within said opening of said first size, said opening of said second size being selectively removable from within said opening of said first size by removal of said struts.

2. A recessed light frame as claimed in claim 1, further comprising:

means for mounting a ballast bracket on said generally planar member including means defining a bracket receiving channel and a clip resiliently extendable into a clip receiving opening in the ballast bracket to hold the ballast bracket on said generally planar member.

3. A recessed light frame as claimed in claim 2, wherein two of said means for mounting the ballast bracket are provided on an edge of said generally planar member for receiving two of the ballast brackets so that a ballast mounted on the ballast brackets is supported at said edge.

4. A recessed light frame as claimed in claim 3, wherein said two of said means for mounting the ballast bracket are at a first edge of said generally planar member and two further means for mounting the ballast bracket are at a second edge opposite said first edge so that a ballast is selectively mountable at said first edge and alternately at said second edge.

5. A recessed light frame as claimed in claim 1, further comprising:

support bracket mounting portions on said generally planar member on opposite sides of the opening, said support bracket mounting portions adapted for connection to a support bracket to support said generally planar member above a plane of a ceiling.

6. A recessed light fixture as claimed in claim 1, further comprising:

a first lip extending perpendicularly relative to a plane of said generally planar member at the opening of the first size so that said lip extends into an opening corresponding to the first size in the ceiling; and a second lip extending perpendicularly relative to a plane of said generally planar member at the opening of the second size so that said lip extends into an opening corresponding to the second size in the ceiling.

7. A recessed light fixture as claimed in claim 6, wherein said second lip extends for a greater distance from the plane of said generally planar member than said first lip for extending through an opening in a ceiling panel while said first lip is disposed above the ceiling panel.

* * * * *